United States Patent [19]

Teeple

[11] 3,958,820

[45] May 25, 1976

[54] DOOR LOCK WITH AUTOMATIC UNLOCKING MEANS

[75] Inventor: Lawrence R. Teeple, Portland, Oreg.

[73] Assignee: Lawrence R. Teeple, Jr., Palo Alto, Calif.

[22] Filed: Nov. 25, 1974

[21] Appl. No.: 526,859

[52] U.S. Cl. ..... 292/92; 292/181; 292/336.3

[51] Int. Cl.[2] ..... E05C 15/02

[58] Field of Search ..... 292/92, 177, 178, 179, 292/180, 181, 229

[56] References Cited

UNITED STATES PATENTS

| | | | |
|---|---|---|---|
| 1,394,635 | 10/1921 | Maturo | 292/181 |
| 2,714,030 | 7/1955 | Gardner | 292/178 |
| 2,828,151 | 3/1958 | Brotman et al. | 292/144 |
| 3,423,118 | 1/1969 | Waldo | 292/229 |

*Primary Examiner*—Albert G. Craig, Jr.
*Attorney, Agent, or Firm*—James D. Givnan, Jr.

[57] ABSTRACT

A lock mechanism including a bolt spring biased toward an unlocked position. Bolt release means including a lever movably mounted on a lock base retaining the spring biased bolt in a locked position. Contact means carried by said lever responsive to hand motion resulting in lever movement and release of the bolt to provide for automatic door unlocking.

9 Claims, 4 Drawing Figures

EXIT

DOOR LOCK WITH AUTOMATIC UNLOCKING MEANS

BACKGROUND OF THE INVENTION

The present invention relates generally to door lock mechanisms and particularly to a lock mechanism for use on doors where automatic unlocking is a requirement or at least highly desirable. Locks on so called panic doors at emergency exits fall within this category. Municipal ordinances and/or state regulations ordinarily require automatic unlocking of panic doors to enable unhindered egress from a building.

Panic doors installed within public buildings, in accordance with the applicable building code, must permit opening without special knowledge being required of the person for obvious reasons. As a practical matter, such doors must be securely locked when not in use to prevent unauthorized entry into a building. For one reason or another panic doors often serve as a means for unauthorized entry particularly in apartment houses and public buildings where the panic doors exit into alleys, little used walkways and the like. Commonly found on panic doors is a lock mechanism including an actuating pressure bar offset inwardly and extending across the door which unlocks the door upon a person pushing against same. The bolt in such lock mechanisms swings about a vertical axis and is susceptible to tampering. A further drawback is the necessity to physically test the door to determine whether or not it is locked as the condition of same is not discernible simply from door appearance. A still further disadvantage of known panic door locks is their complexity and cost.

SUMMARY OF THE INVENTION

The present invention is embodied within a door lock mechanism including contact means in close proximity to a doorknob or other hand actuated door accessory to initiate automatic unlocking upon a person's hand contacting the door. Said contact means is disposed so as to be displaced during grasping or actuation of a door bar and accordingly satisfies the automatic opening requirement for panic doors. Suitable linkage releases a bolt for spring biased retraction away from a bolt keeper in the jamb adjacent the door. The bolt accordingly provides the desirable security features of a dead bolt lock yet permitting automatic opening in emergency situations upon actuation of door hardware in accordance with a person's natural tendency or habit pattern.

Important objects of the present invention include: the provision of a lock mechanism including a bolt retracted to a door unlocking position by spring means triggered by a person grasping a doorknob or other door accessory; the provision of a panic door lock having the attributes of a dead bolt type lock yet meeting panic door requirements for automatic opening during emergency situations; the provision of a door lock providing a visual indication of a locked or unlocked condition; the provision of a door not susceptible to tampering; and the provision of an uncomplicated door lock mechanism of high reliability with a minimum number of components interacting in a positive manner.

DETAILED DESCRIPTION OF THE PREFERRED EMBODIMENT

Figures 1, 2, 3, 4:
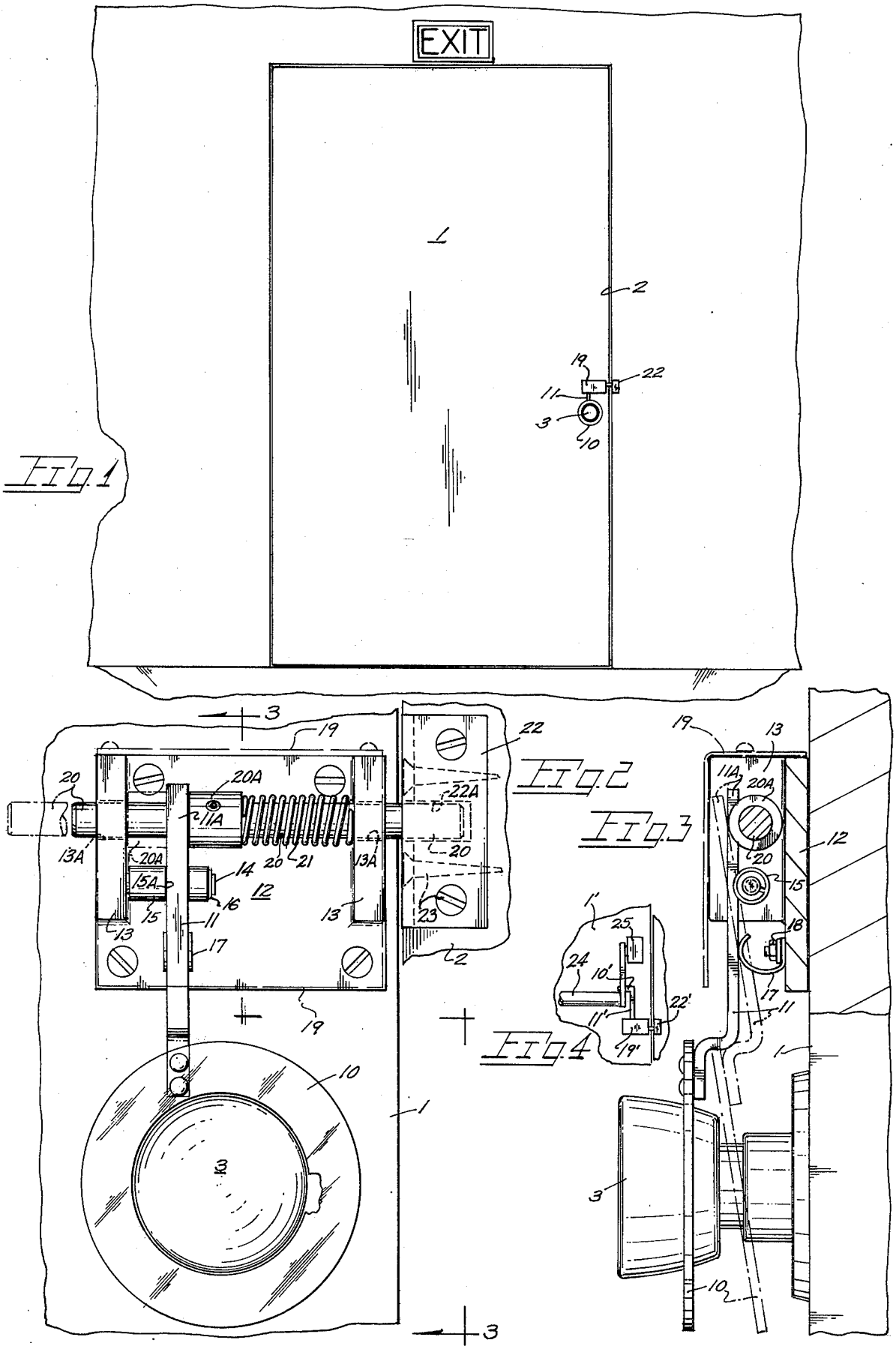
FIG. 1 is an elevational view of a panic door with the present lock mechanism thereon.
FIG. 2 is an enlarged frontal view of the lock mechanism with a cover plate removed.
FIG. 3 is a sectional, elevational view taken along line 3—3 of FIG. 2.
FIG. 4 is a fragmentary elevational view of a panic door with a modified form of the invention thereon.

With continuing reference to the accompanying drawings wherein applied reference numerals indicate parts similarly identified in the following specification, the reference numeral 1 identifies a door within a door frame including a doorjamb 2. Door 1 may be considered a panic door, however, it is to be understood the present lock is not so restricted in application but rather may be applied to various types of doors. The term panic door, as presently used, identifies a door permitting emergency egress from a building structure and is subject to governmental ordinances or codes enacted for the purposes of public safety. Generally speaking, panic doors must open in an obvious manner without requiring opening knowhow on the person's part.

In FIG. 1, door hardware or accessories include a doorknob indicated at 3 of conventional appearance which may be associated with a conventional bolt and bolt actuating means. The doorknob shown is of importance from a functional standpoint in that it contributes to the desired appearance of a conventional door opened and closed by the singular act of manually rotating the doorknob.

The present locking mechanism includes bolt release means including contact means comprising a contact member 10 disposed adjacent the periphery of doorknob 3 so as to be contacted by a person's hand during grasping of the doorknob. Contact member 10 is of circular configuration with minimum annular clearance from the knob surface. Said bolt release means further includes means extending intermediate said contact member and a later described bolt, the last mentioned means shown as a bolt retention lever 11 suitably secured to the contact member 10 and terminating in abutment with the later described bolt.

A lock base 12 includes end walls 13 one of which mounts a pivot pin 14 about which a sleeve 15 may rock to swingably support lever 11. A snap ring 16 holds pivot sleeve 15 against displacement. Lever 11 extends through a chordal recess 15A in the sleeve and is thereat suitably secured as by a weld. A spring finger 17 secured to base 12 at 18 biases lever 11 about its fulcrum to locate contact member 10 adjacent doorknob 3 as viewed in full lines in FIG. 3.

A bolt at 20 is slidably mounted within apertures 13A in walls 13 with spring means at 21 interposed between a wall 13 and a radially extending wall surface of a bolt collar at 20A. Accordingly, bolt 20 is biased to the left as viewed in FIG. 2 with the end segment 11A of lever 11 retaining bolt 20 against spring action.

A keeper at 22 on doorjamb 2 defines a bolt receiving socket 22A while fasteners at 23 extending into the doorjamb secure the keeper against dislodgement. A cover plate 19 is suitably secured to base 12 to conceal lock components.

With attention to FIG. 3, it will be seen that contact member 10 is inwardly displaced toward the surface of door 1 by hand contact during grasping of the doorknob resulting in lever 11 being displaced to disengage end segment 11A from bolt collar 20A permitting bolt retraction to the broken line position. In an unlocked condition bolt collar 20A rests against base wall 13 at the left side of base 12 with lever end 11A at rest on said collar. Locking is reaccomplished by axial displacement of the bolt by fingertip pressure until collar 20A clears the lever permitting automatic resetting of the lever in response to the action of spring finger 17.

In FIG. 4 a modified form of the invention is shown with prime reference numerals identifying similar structure earlier described in conjunction with the first described form of the invention. Door 1' is fitted with a bar accessory at 24 swingably mounted at its ends as at 25 permitting arcuate travel toward the surface of door 1' in response to hand pressure. Spring return means, not shown, positions bar 24 outwardly from door 1'. The modified form of the invention includes a lever 11' of a lock mechanism inverted from its earlier disclosed position. Contact member 10' in the form of an extension of lever 11' rests in contact with the rearward side of door mounted bar 24. Inward movement of bar 24 in response to manual pressure exerted thereon results in like movement of the exposed segment of lever 11' for retraction of the bolt from a keeper 22' in the manner described earlier.

While I have shown but a few forms of the invention it will be apparent to those skilled in the art that the invention may be embodied still otherwise without departing from the spirit and scope of the invention.

Having thus described the invention what is desired to be secured under a letters Patent is:

1. A lock mechanism for use on panic doors and the like permitting automatic unlocking of the door during normal gripping of a doorknob, said lock mechanism comprising, a base in place on said door, a bolt slidably carried by said base and axially extensible beyond a door edge into locked engagement with a door frame mounted keeper, spring means acting on said bolt axially biasing same towards a retracted door unlocking position, and bolt release means including a hand actuated contact member in close proximity to the doorknob, said contact member disposed so as to be contacted and displaced by a person's hand during gripping of the doorknob, said bolt release means further including a lever supporting said hand actuated member, said lever additionally serving to restrain the spring biased bolt to hold same extended in a door locking position against the action of said spring means whereby displacement of said contact member by the door opening hand will release said bolt for spring retraction.

2. The lock mechanism as claimed in claim 1 wherein said lever swings about an axis parallel to the major bolt axis.

3. The lock mechanism as claimed in claim 2 additionally including a spring finger urging an end segment of said lever into restraining contact with said bolt.

4. The lock mechanism as claimed in claim 3 wherein said bolt includes a radially extending wall surface in abutting restrained contact with said end segment of the lever.

5. The lock mechanism as claimed in claim 1 wherein said contact member is of arcuate configuration along at least one edge for proximate placement to the doorknob.

6. A locking mechanism for use on panic doors and the like permitting automatic unlocking of the door by a person's hand during gripping of a door mounted doorknob, said lock mechanism comprising, a base, a bolt slidably carried by said base and axially extendable beyond a door edge into locked engagement with a door frame, and means operable to automatically retract said bolt for door unlocking during gripping of the doorknob, said automatic means including bolt release means having a hand actuated contact member radially spaced outwardly from the doorknob, means extending intermediate said contact member and said bolt, and operable upon the bolt to release same in response to displacement of the contact member by the hand during normal gripping of the doorknob.

7. The locking mechanism as claimed in claim 6 wherein said means to automatically retract said bolt further includes spring means acting on the bolt axially biasing same toward the retracted, door unlocking position.

8. The locking mechanism as claimed in claim 7 wherein said intermediate means is in restraining contact with the bolt holding same in extended locked engagement against said spring means.

9. The locking mechanism as claimed in claim 8 wherein said hand actuated contact member is of annular configuration.

* * * * *